US005280896A

United States Patent [19]

Yamada

[11] Patent Number: 5,280,896

[45] Date of Patent: Jan. 25, 1994

[54] SHEET REFEEDING DEVICE

[75] Inventor: Yasushi Yamada, Hachioji, Japan

[73] Assignee: Konica Corporation, Tokyo, Japan

[21] Appl. No.: 942,970

[22] Filed: Sep. 10, 1992

[51] Int. Cl.[5] ..... B65H 5/22

[52] U.S. Cl. ..... 271/3.1; 271/212; 271/197; 271/204; 198/803.1; 198/577

[58] Field of Search ..... 271/3.1, 212, 197, 199, 271/204, 82, 277; 198/803.1, 577

[56] References Cited

U.S. PATENT DOCUMENTS

| | | | |
|---|---|---|---|
| 1,997,267 | 4/1935 | Remington | 198/803.1 |
| 2,926,908 | 3/1960 | Bobst | 271/277 |
| 4,069,728 | 1/1978 | McCrea | 271/277 |
| 4,478,404 | 10/1984 | Garavuso | 271/212 |
| 4,593,897 | 6/1986 | Silverberg | 271/212 |
| 5,022,641 | 6/1991 | Okada | 271/212 |
| 5,092,576 | 3/1992 | Takahashi et al. | 271/3.1 |

FOREIGN PATENT DOCUMENTS

| | | | |
|---|---|---|---|
| 3-73736 | 3/1991 | Japan | 271/277 |

*Primary Examiner*—H. Grant Skaggs
*Attorney, Agent, or Firm*—Jordan B. Bierman

[57] ABSTRACT

An apparatus for repeatedly feeding a pile of sheets to a copy section, including a feeding device to feed a sheet from the top of the pile of sheets to the copy section; a returning device to return a sheet from the copy section to the pile of sheets; and a inserting device to insert a sheet under the bottom of the pile of sheets stacked on the sheet stand.

12 Claims, 8 Drawing Sheets

SHEET REFEEDING DEVICE

BACKGROUND OF THE INVENTION

The present invention relates to a circulation type of sheet refeeding device, for example, a circulation type of document conveyance device in which sheets stacked on a stacker are fed to a platen glass one by one and exposed sheets are returned to the stacker so that the sheets can be repeatedly fed to the platen glass. More particularly, the present invention relates to an automatic circulation type of sheet refeeding device in which the uppermost sheet of a sheet stack is conveyed to the platen glass and returned to the stack after it has been exposed.

An automatic document feeding device (ADF) has already been provided which can effectively and automatically feed documents to a recording device such as an electrophotographic copier and a recording image reader. However, conventional automatic document feeding devices are applied to the copying operation in which only one side of a document is copied.

On the other hand, there is a great need of a copier which can copy images on a two-sided document onto one side or both sides of a recording paper, and also there is a need of an image reading apparatus which can read and record images on a two-sided document. Therefore, various reversible automatic document feeders (RADF) provided with document reversing function have been proposed until now. Those automatic document feeders (RADF) are disclosed in Japanese Patent Application Open to Public Inspection Nos. 216159/1984, 112738/1978 and 8834/1985, and Japanese Utility Model Open to Public Inspection No. 4548/1984.

On the other hand, a circulation type of document feeder (RDH) has been proposed in which documents stacked on a stacker are automatically fed one by one to a platen glass of a copier and the exposed document is returned to the stacker so that it can be exposed again.

When the aforementioned circulation type of document feeder (RDH) is operated by one circulation, a volume of copies can be made, so that the documents are circulated by the number of necessary volumes.

Recently, the applicant has proposed a new circulation type of document feeder composed of the aforementioned RDH to which a document reversing mechanism is added (Japanese Patent Application Open to Public Inspection No. 20228/1988).

When the aforementioned circulation type of document feeder is provided, a high speed continuous copying operation can be carried out and copied recording papers can be sorted in the order of pages. Further, when the copying apparatus is connected with a finisher which conducts a stapling and punching operation, all recording operations can be automatically carried out.

In the aforementioned circulation type of document feeder (RDH), documents are fed in the following manner: the front side of a document is set upward on the stacker; the lowermost document of the document stack is fed to the platen glass one by one; and the exposed document is returned on the uppermost document of the document stack. The aforementioned system will be referred to as a bottom-feed/top-restack system, hereinafter.

In the aforementioned circulation type of document feeder (RDH), that is, in the bottom-feed/top-restack system, the document surfaces are rubbed with each other, so that the document surfaces are stained and images are damaged. Especially when the document is written with a pencil, the aforementioned problems are remarkable.

In order to solve the aforementioned problems, a circulation type of automatic document feeder is disclosed in Japanese Patent Application Open to Public Inspection No. 37536/1981, which is operated in the following manner: the uppermost document of a stack is fed to the platen glass; and the exposed document is returned to the lowermost portion of the stack. In the aforementioned system, an exposed document sheet is inserted under a document stack when the stack is lifted by a periodic motion type of lifting means.

On the other hand, in the fields of an image recording apparatus such as an electrophotographic copier and a printing apparatus, various two-sided automatic recording apparatus are proposed, which can record not only on one side of a recording paper but also on both sides. In a conventional two-sided automatic recording apparatus, a document image is recorded on one side of a recording paper in an image processing section, and then the recording paper is temporarily stored. After that, the recording paper is conveyed again so that it is fed to the image forming section. The aforementioned type of automatic recording paper refeeding device (ADU) is disclosed in Japanese Patent Application Open to Public Inspection Nos. 82247/1984, 114227/1984 and 2241/1985.

In the aforementioned automatic two-sided recording copier, a recording paper, on one side of which an image has already been formed, is conveyed under the copying section and accommodated in a stacker section.

After a recording paper, on one side of which an image has already been formed, has been stacked in the stacker, it is refed under the condition that the trailing edge is taking the lead. Then, the recording paper is conveyed by a conveyance device through a conveyance guide, and enters the image forming section again. After that, a toner image formed on a photoreceptor is transferred onto the recording paper. Then, the transferred image is fixed by a fixing unit, and the recording paper is accommodated on a tray disposed outside the apparatus.

Even in the case of the aforementioned ADU, on a conventional stacker, recording papers on which images have been recorded, are stacked on the uppermost paper on the stacker, and the lowermost recording paper is fed one by one. Accordingly, the surface of the recording paper is stained due to the friction between the front and reverse sides of the recording paper. Therefore, it is preferable that the uppermost recording paper is fed and the recording paper on which the image has been formed, enters the lowermost portion of the stack. The aforementioned system will be referred to as a top-feed/bottom-restack system, hereinafter.

In RDH and ADU of the aforementioned top-feed/-bottom-restack system, the following problems are caused.

(1) The structure of the lifting means which lifts the stack of papers periodically, becomes complicated.

(2) When the leading edge of the recording paper inserted under the stack, is curled, there is a high possibility that the leading edge interferes with the periodical motion type of lifting means.

(3) In the case where the sheet returning speed is high, there is a high possibility that the motion of the sheet conveyance device becomes unstable since its structure is complicated.

(4) Since the stack lifting means goes up and down each time a recording sheet is returned, noises are made.

(5) When the sheet size is changed, it is difficult to adjust the apparatus to the size.

The present invention has been achieved to solve the aforementioned problems of the prior art. It is a primary object of the present invention to provide a top-feed/-bottom-insertion type of sheet refeeding device which can be stably operated even in a high speed operation and appropriately adjusted to various sheet sizes.

SUMMARY OF THE INVENTION

In order to attain the aforementioned object, the present invention is to provide a sheet refeeding device, comprising: a stacker on which a plurality of sheets can be stacked; a sheet feeding means which can feed the uppermost sheet on the stack to a processing section one by one; an insertion means which can insert a sheet returned from said processing section into the lowermost portion of the stack; a rotating member which is brought into contact with at least a portion of the leading edge of a sheet returned to the bottom portion of the stack, and which can be moved on the stacker in the direction of the returning sheet, being linked with the movement of the sheet; a drive means to drive said rotating member; a detection means which can detect the end portion of the sheet at an outlet to return to the stacker; and a control means which controls said drive means for said rotating member in accordance with a sheet end passing detection signal sent from said detection means.

Said rotating means includes a holding section which can hold at least a portion of the leading edge of a sheet.

Said rotating means includes an endless feeding belt provided with said holding section.

DETAILED DESCRIPTION OF THE PREFERRED EMBODIMENT

With reference to the attached drawings, an embodiment of the copier provided with the sheet refeeding device (RDH and ADU) of the present invention will be explained as follows.

Figure 1:
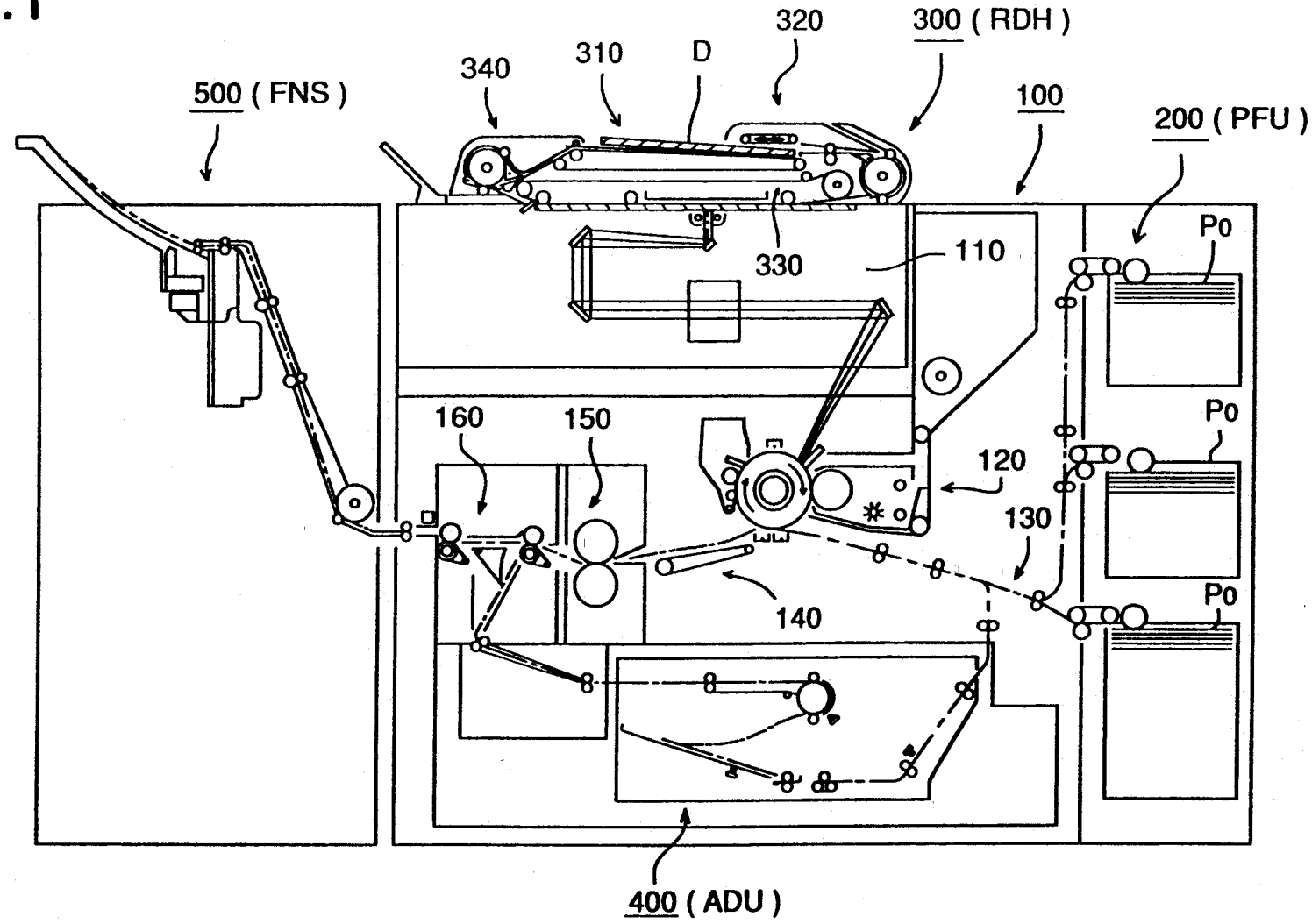
FIG. 1 is a view showing the entire structure of a copier provided with a circulation type of document feeder (RDH) to which the sheet refeeding device of the present invention is applied.

FIG. 1 is a view showing the entire structure of a copier. In the drawing, numeral 100 is a copier body, numeral 200 is a paper supply unit (PFU), numeral 300 is a circulation type of document feeder (RDH), numeral 400 is a recording paper refeeding device (ADU), and numeral 500 is a recording paper processing device (a finisher referred to as an FNS device, hereinafter).

The copier body 100 includes a scanning exposure section 110, image forming section 120, paper supply section 130, conveyance section 140, fixing section 150, and discharged paper changeover section 160.

In FIG. 1, a one-dotted chain line denotes a conveyance passage for recording paper P. This conveyance passage includes the following two passages. One is a conveyance passage in which recording paper P0 accommodated in the paper supply unit (PFU) 200 is sent to the image forming section 120 so that an image can be formed on its surface, and then the recording paper is sent to the FNS device 500 through the conveyance section 140, fixing section 150, and discharged paper changeover section 160. This passage is referred to as a main route. The other is a conveyance passage which branches off from the discharged paper changeover section 160. Recording paper P in this passage is temporarily stored in the ADU device 400, and then refed to the paper feed section 130 of the copier body 100.

Figure 2:
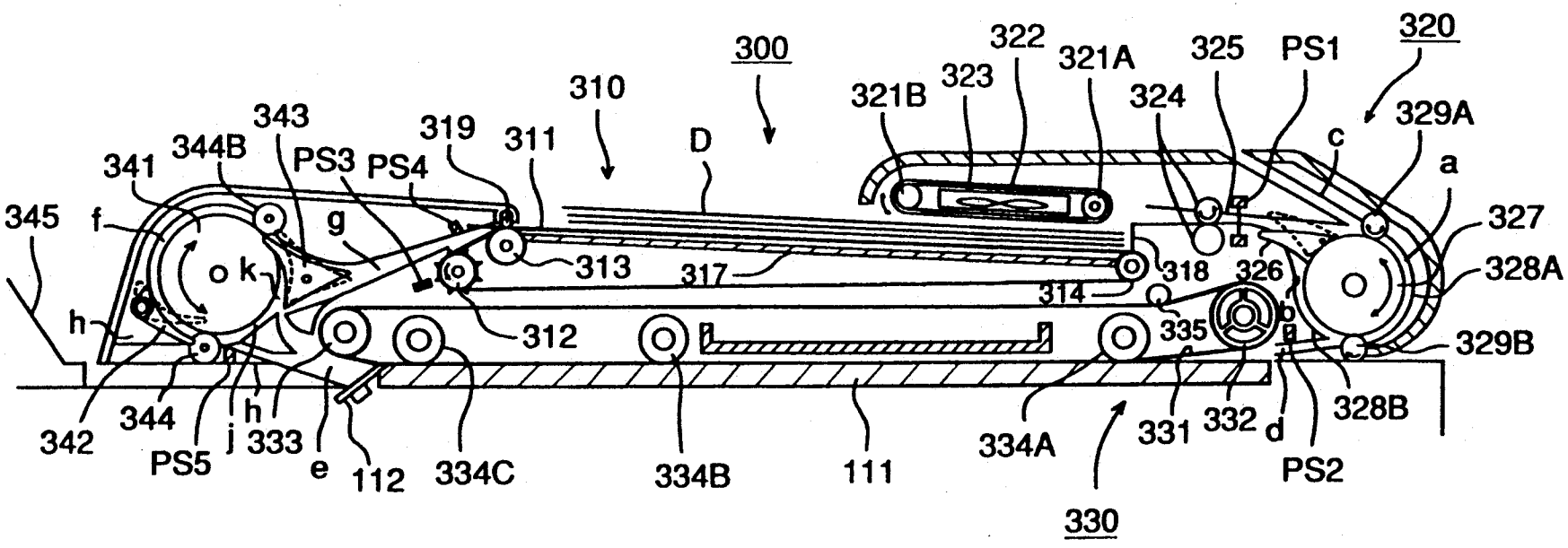
FIG. 2 is a sectional view of the aforementioned document feeder (RDH)

FIG. 2 is a sectional view of the RDH device 300 provided on the copier body 100.

The present invention can be applied to an automatic document feeder (RDH) such as the RDH device 300 which is operated in the following manner: a plurality of documents (one-sided documents or two-sided documents) are conveyed from a document stacker 310 onto a platen glass 111 of the copier body 100 so that the documents are exposed; and then the exposed documents are returned to the document stacker 310.

The RDH 300 includes the document stacker 310, supply section 320, conveyance section 330, and discharged paper inversion section 340.

Figure 3:
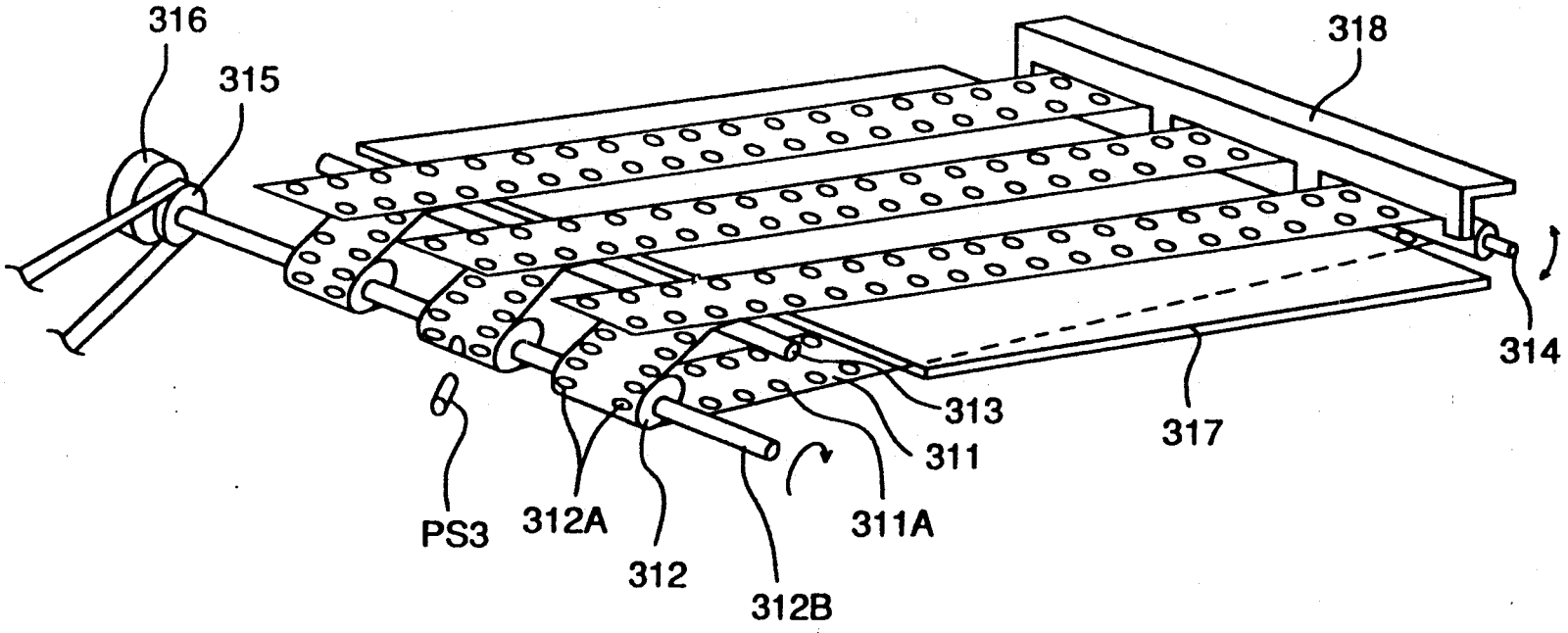
FIG. 3 is a perspective view of the essential portion of a document stacker.

FIG. 3 is a perspective view showing the essential portion of the document stacker 310. Numeral 311 is a plurality of rotatable endless feed belts which support document D. The feed belts 311 are wrapped around a drive roller 312, idle roller 313 and idle roller 314. Perforations 311A are provided on both sides of the feed belt 311. When the perforations 311A are engaged with a sprockets 312A provided around the idle roller 312, the feed belt 311 can be driven by the drive roller 312.

Figure 4:
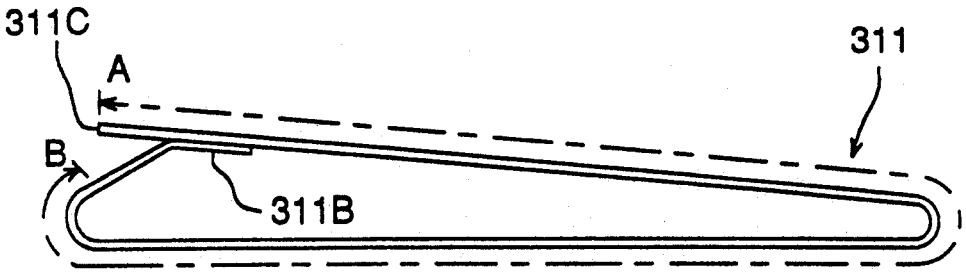
FIG. 4 is a side view of a feed belt of the aforementioned document stacker.
Figure 5:
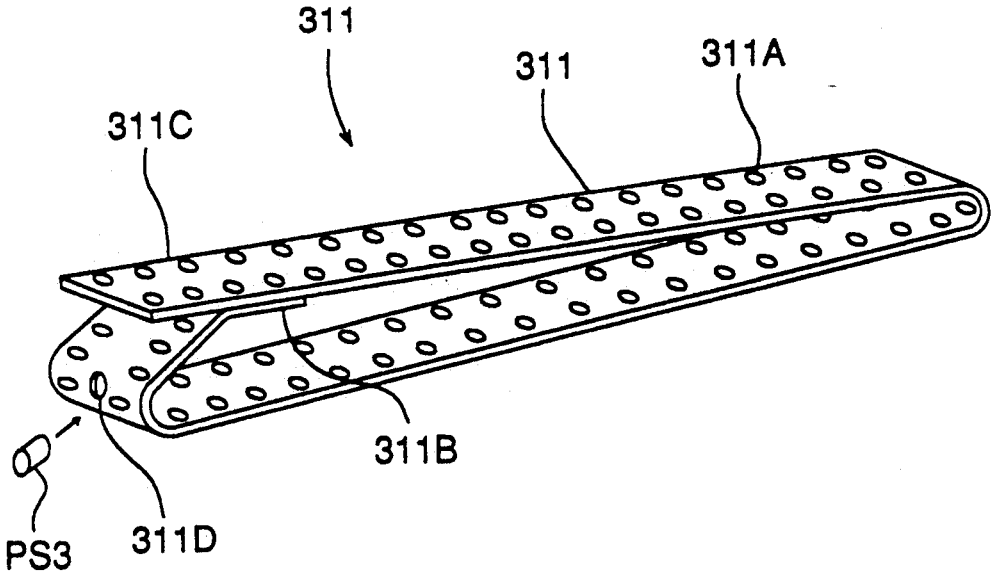
FIG. 5 is a perspective view of the feed belt.

FIG. 4 is a side view of the feed belt 311, and FIG. 5 is a perspective view of the feed belt 311. One end portion of the feed belt 311 is connected with the feed belt 311 through a joint 311B so that the feed belt 311 is formed into a loop.

The other end portion of the feed belt 311 is extended outside so that an extended holding portion 311C is formed. The feed belt 311 is made of a cloth belt coated with resin or a polyethylene terephthalate film (PET). The inside surface of the extended holding portion 311C of the feed belt 311, and the surface of the feed belt 311 corresponding to it, are made rough so that the frictional coefficient can become high. Other outside surfaces (the range from A to B in FIG. 4) of the feed belt 311 are made smooth so that the frictional coefficient can become low. In FIG. 5, numerals 311D is a through hole (a detected portion) formed in the feed belt 311, by which a belt position can be detected with belt position detecting sensor PS3, and the start and stop of the feed belt 311 can be controlled. The aforementioned through hole (the detected portion) may be substituted by a mark so that the mark can be detected by a reflection type of sensor.

A pulley 315 and electromagnetic clutch 316 connected to a drive source, are provided at the end of the rotating shaft 312B of the drive roller 312. A fixed plate 317 is provided between the idle rollers 313 and 314 inside the feed belt 311. Document stack D on the feed belt 311 can be supported flat by the fixed plate 317. Numeral 318 is a stopper which aligns the top portions of documents of document stack D. Numeral 319 is a push roller which pushes by the action of the weight or spring force.

A perforated feed belt 322 which is rotated being wrapped around a drive roller 321A and an idle roller 321B, is provided at a position close to the tip of the fixed plate 317, wherein the position is located above the fixed plate 317. The feed belt 322 can be oscillated around the drive roller 321A when the idle roller 321B is oscillated. A suction fan 323 is provided inside the feed belt 322, which is oscillated integrally with the feed belt 322, and the uppermost document on the document stack is sucked through the holes formed in the feed belt 322 by the action of the suction fan 323, so that the uppermost document is separated from the stack and fed onto the surface of the feed belt 322.

A pair of intermediate conveyance rollers 324 and a document passing detection sensor PS1 are provided in the downstream of the feed belt 322.

A sheet of document which has been fed by the feed belt 322 and suction fan 323, is conveyed by a pair of intermediate conveyance rollers 324, and when the document passes, its leading edge is detected by document passing detection sensor PS1, and then the document is conveyed in a guide plate 325 so that it is conveyed to the next branch section.

As shown in FIG. 2, in the branch section, a changeover claw 326 is oscillated so that the passing of the document can be changed over between passages a and b. Passage a is formed between the circumferential surface of a reversible large diameter roller 327 provided on the paper feed side, and curved guide plates 328A, 328B. Drive rollers 329A and 329B are brought into pressure contact with the circumferential surface of the large diameter roller 327 so that the drive rollers 329A, 329B are idly rotated so as to convey the document. In this case, c denotes a reverse passage, and d denotes a paper supply outlet passage.

Figure 6A:
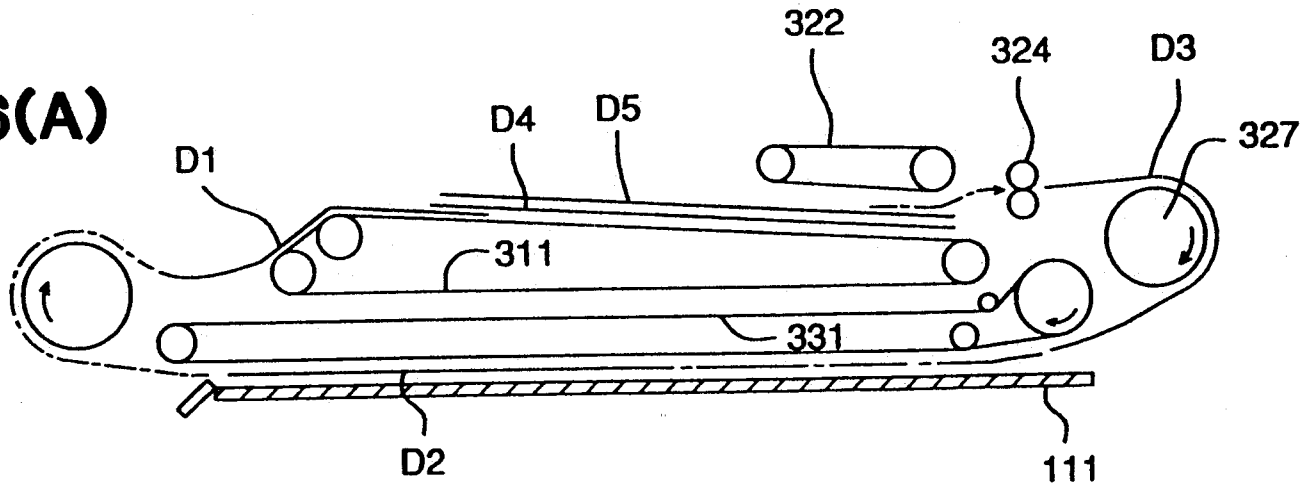
FIGS. 6(A) and 6(B) are schematic illustrations illustration showing a model of document conveyance passage in RDH mode.
Figure 6B:
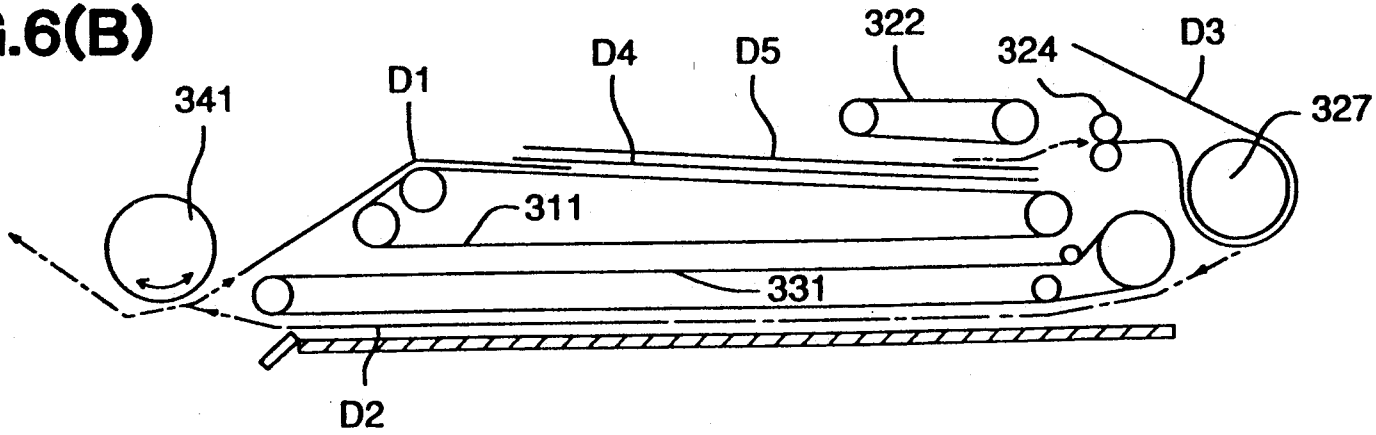

FIG. 6 is a schematic illustration showing a document conveyance passage in the case of RDH mode. In this drawing, (A) denotes a normally conveyed document circulation passage, and (B) denotes a reversely conveyed document passage.

In the case where a document D is sent onto the platen glass 111 and the front side of the document is exposed, document D passes above the changeover claw 326 which has been set downward, and advances to the platen glass 111 in the first paper supply passage through passages a and d.

In the case where the reverse side of a document is exposed, the changeover claw 326 is oscillated upward so that document D is introduced to passage b. Then, document D advances along the circumferential surface of the large diameter roller 327 in such a manner that document D goes back in passages a and c. After document D has been temporarily stopped and inverted, it advances in the second paper supply passage from outlet passage d to the surface of the platen glass 111.

In the middle of paper supply outlet passage d, document passing synchronization sensor PS2 is disposed. When the tip of a document passes through sensor PS2, a detection signal is sent from the sensor so that the timing of document conveyance can be controlled. That is, sensor PS2 controls the operations of a document stopper 112, drive motor, paper supply clutch, and conveyance clutch through a clock timer.

Document D fed from outlet passage d is held between the rotating conveyance belt 331 and the platen glass provided on the upper surface of the copier body 100. Then, document D is stopped at a position in which document D collides with the document stopper 112 which has been projected on the surface by the action of a latch type of solenoid valve.

The aforementioned conveyance belt 331 is wrapped around a drive roller 332, idle roller 333, three document holding rollers 334A, 334B, 334C, and tension roller 335.

Document D which has been set on the platen glass 111, is exposed by the scanning exposure section 110 of the copier 100, so that the document image can be formed on a recording body.

After exposed, document D passes through the document stopper 112 which has been withdrawn, and advances to the discharged paper inversion section 340.

The discharged paper inversion section 340 includes the large diameter roller 341 on the paper discharging side, changeover claw 342, branch plate 343, drive rollers 344A, 344B, and guide plate. Passages e, f, g, and h are formed in the discharged paper inversion section 340.

Figure 7A:
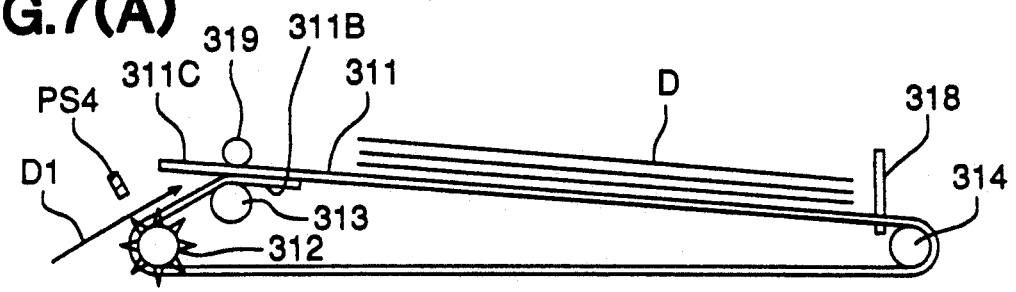
FIGS. 7(A), 7(B) and 7(C) are schematic illustrations showing the conveyance state of a document which has been discharged onto a feed belt from a discharged paper inversion section.
Figure 7B:
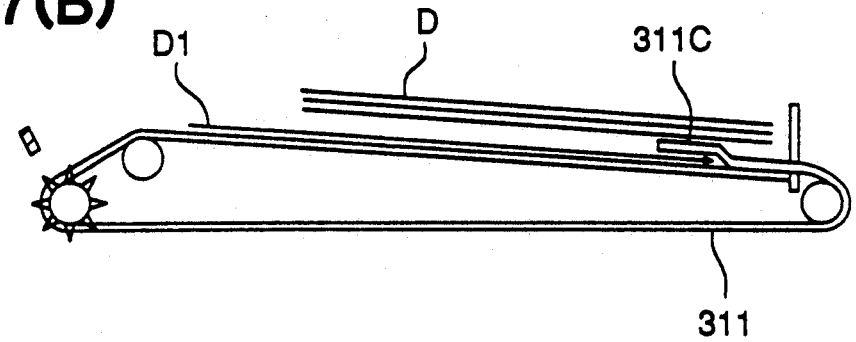
Figure 7C:
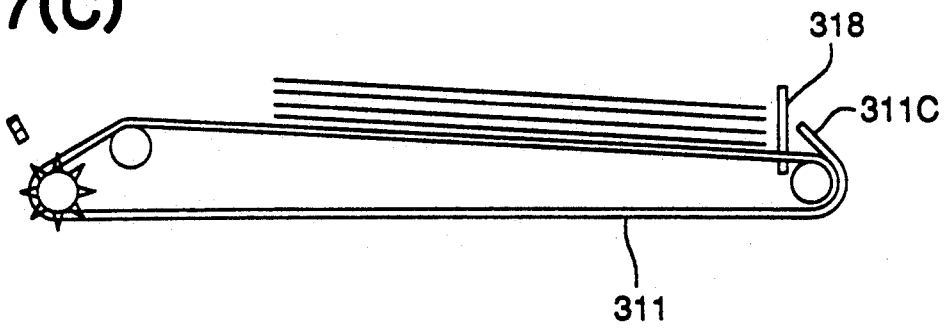

FIG. 7 is a schematic illustration showing the state of conveyance of document D which is discharged from the discharged paper inversion section 340 to the conveyance belt 311.

As shown in FIG. 2, document D discharged from the surface of the platen glass 111 advances in the first discharge passage including passage e, idle roller 334A, changeover claw 342 which has been set downward, passage f, idle roller 344B, and passage g. Then, the leading edge of document D is inserted into a portion close to the joint 311B of the conveyance belt 311 which is waiting under the condition that the extended holding portion 311C is opened (FIG. 7(A)).

After the leading edge of document D has been detected by sensor PS4, the clutch 316 is connected, and the leading edge of document D is held by the conveyance belt 311 which has started rotating. Further, document D is set on the conveyance belt 311, and inserted under the stack of unprocessed documents and conveyed to the right in the drawing (FIG. 7(B)).

In this case, the feed belt 322 is located in a higher position, and the tip of document D collides with the stopper 318 so that the document is stopped. The first discharge passage is composed in the manner described above.

The second discharge passage of document D is a document inversion passage composed in the following manner: document D passes through passage e; when the changeover claw 342 is changed over, document D passes through outlet passage h and is temporarily discharged onto a discharged paper tray 345; after the trailing edge of document D has been detected by sensor PS5, document D is immediately switched back when the large diameter roller 341 is reversed and the changeover claw 343 is oscillated; document D passes through passages j and g; the leading edge of document D is inserted into the joint 311B of conveyance belt 311 which is waiting under the condition that the extended holding portion 311C is opened; then, document D is conveyed to the right in the drawing so that it goes under the stack of documents; and the leading edge of document D collides with the stopper 318 and document D is stopped.

Figure 8:
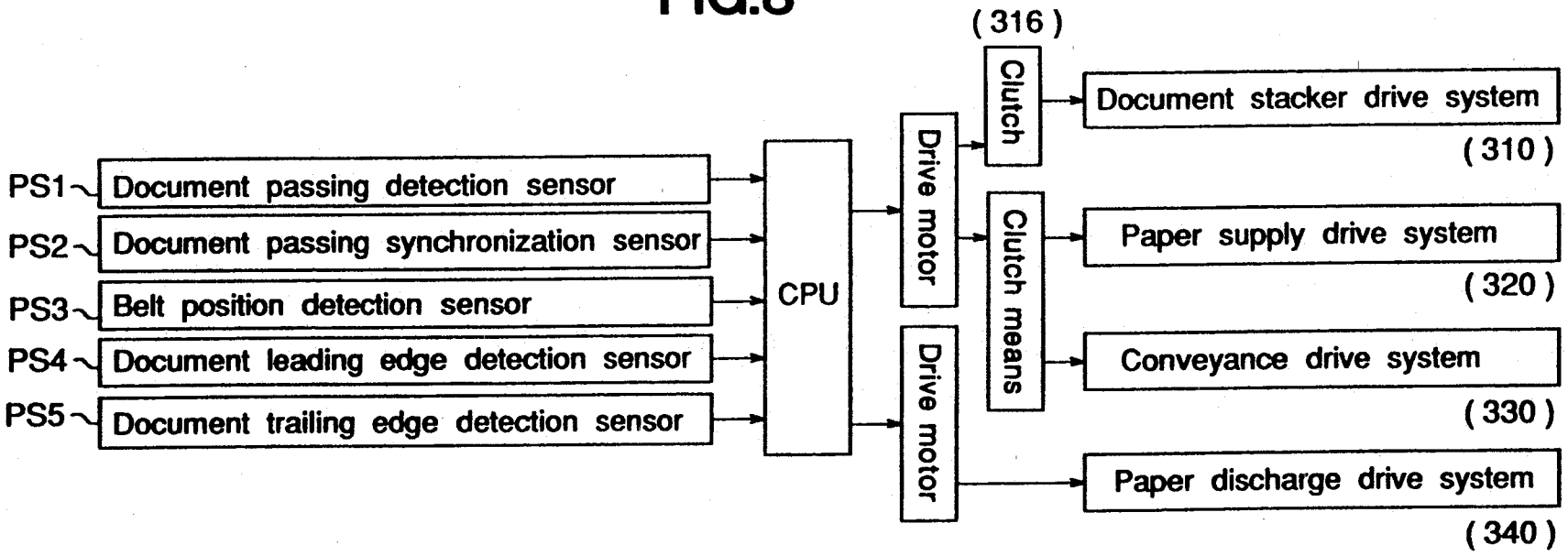
FIG. 8 is a block diagram of a drive system of a document feeder.

FIG. 8 is a block diagram of the drive system of the circulation type of document feeder (RDH). All operations of document circulation and document inversion circulation are controlled by a CPU.

The aforementioned operations are performed in the case where a one-sided document or two-sided document is copied onto one side of a recording paper. In the case where a two-sided document is copied onto both sides of a recording paper, the document is inverted in the first circulation so that the pages of even numbers are copied, and the pages of odd numbers are copied in the second circulation. Of course, recording paper feeding operations of copier P are carried out in accordance with the aforementioned operations of the RDH device 300.

Figure 9A:
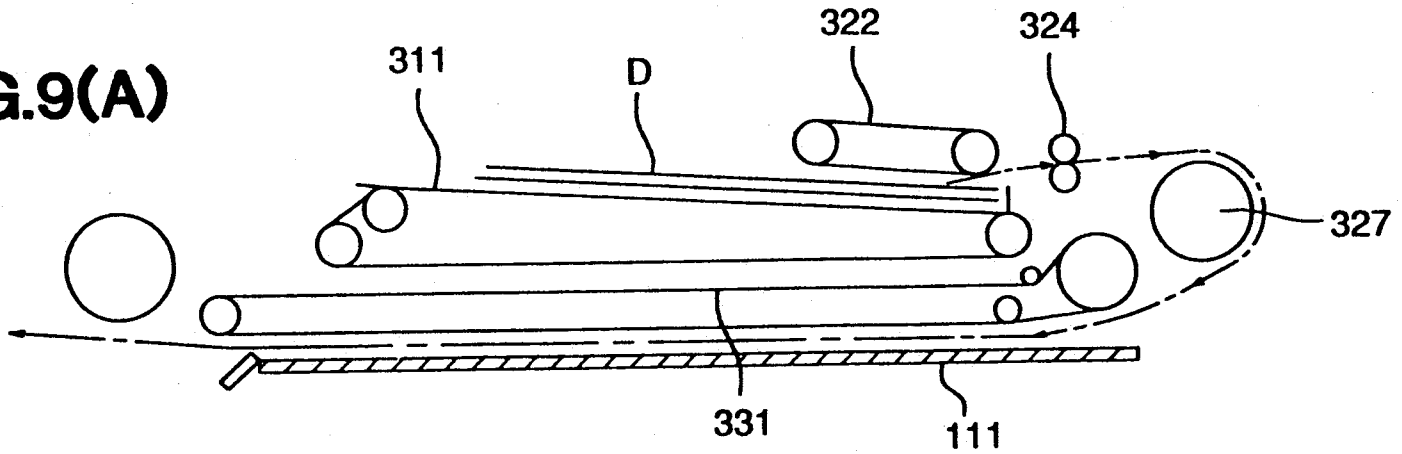
FIGS. 9(A) and 9(B) are schematic illustrations showing document conveyance passages in the cases of RDF mode and RAD mode to which the document feeder is applied.

FIG. 9 is a schematic illustration showing another document conveyance mode of a document feeder provided with the aforementioned RDH mode. FIG. 9(A) shows an ADF mode in which only one side of a document is copied. Document D is sent out from a feed section 320 along the passage indicated by a one-dotted chain line in the drawing. After document D has been exposed on the platen glass 111, it is discharged from the discharged paper inversion section 340 onto a discharged paper tray 345.

Figure 9B:
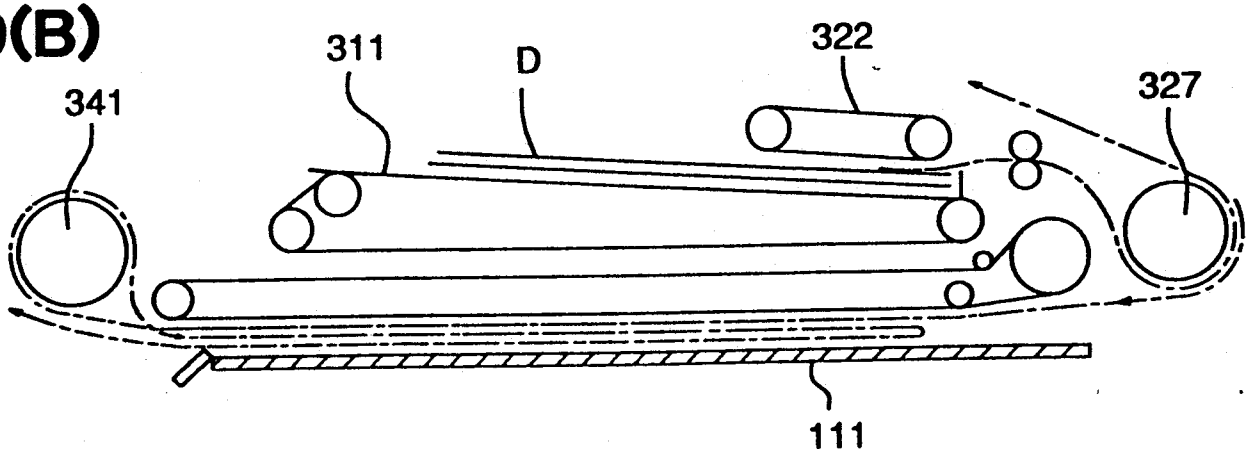

FIG. 9(B) is a schematic illustration showing the RAD mode in which both sides of a document are copied. Document D sent out from the feed section is wound around the large diameter roller 327 provided on the paper feed side so that document D is inverted. Then, document D is conveyed onto the platen glass 111 under the condition that the second side of the document is set downward, and then document D is exposed. After that, document D is wound around the large diameter roller 341 provided on the paper discharge side. Then, document D passes through passage K, and goes back onto the platen glass 111 so that the first side of the document is exposed. After that, document D is discharged onto the discharged paper tray 345.

The conveyance belt provided with the aforementioned extended holding portion in the sheet refeeding device of the present invention, is effectively applied to the circulation type of document feeder (RDH). Further, the conveyance belt provided with the aforementioned extended holding portion can be applied to a sheet refeeding device in which the supplied sheet setting portion and the discharged sheet setting portion are the same.

As explained above, in the sheet refeeding device of the present invention, the uppermost sheet of the sheet stack provided on the sheet stacker, is sent out and returned to the lowermost position of the sheet stack through the paper feed section and the processing section in a closed loop. Therefore, the front and reverse surfaces of sheets are not rubbed, and consequently the sheet surfaces can be kept clean.

Further, the structure of the sheet refeeding device can be simplified, so that the manufacturing cost can be effectively reduced.

In the structure of the present invention, the stack lifting means is not moved upward and downward. Accordingly, the apparatus can be operated at high speed, and further the occurrence of noise can be prevented.

The apparatus of the present invention can provide the aforementioned excellent effects.

What is claimed is:

1. An apparatus for repeatedly feeding sheets from a pile of sheets to a sheet processing section, said apparatus comprising;

a sheet stand on which said pile of sheets is stacked;

a feeder for feeding a sheet from a top of said pile of sheets stacked on said sheet stand, one by one, to said sheet processing section;

a return for returning said sheet from said sheet processing section to said sheet stand; and an inserter for inserting said sheet under a bottom of said pile of sheets stacked on said sheet stand, said inserter including:

a conveyance member comprising an endless belt arranged to pass under said pile of sheets, and a holding member fixed to said endless belt to hold a leading edge of said sheet between said holding member and a belt surface of said endless belt, whereby said endless belt conveys the sheet, together with said holding member, and inserts the sheet under said pile of sheets, wherein a portion of said holding member fixed to said endless belt does not protrude above the belt surface of said endless belt at a position upstream of said holding member;

a detection member for detecting passage of a sheet returned to said sheet stand and for outputting a detection signal; and a control member for controlling said conveyance member on the basis of said detection signal to hold the leading edge of the sheet with said holding member.

2. The apparatus of claim 1, wherein the endless belt is arranged to pass with the sheet held by the holding member under the bottom of the pile of sheets.

3. The apparatus of claim 2, wherein a holding surface of the holding member of the endless belt to hold the sheet is so made that the frictional coefficient is higher than that of the other surface of the endless belt.

4. The apparatus of claim 3, wherein the endless belt and the holding member are made of one piece of belt so that the belt is looped and an edge portion is extended over the joint of the loop to form the holding member.

5. The apparatus of claim 1, wherein the control member controls the conveyance member on the basis of the detection signal so that the holding member receives and holds the leading edges of the sheets.

6. The apparatus of claim 1, further comprising means for detecting a home position of the conveyance member.

7. The apparatus of claim 6, wherein control member controls the conveyance member on the basis of the home position detection signal to stop the holding member at the predetermined position.

8. The apparatus of claim 6, wherein the conveyance member is arranged to come in contact with the leading edge of the returned sheet at the home position.

9. An apparatus for repeatedly feeding a pile of sheets to a sheet processing section, said apparatus comprising;

a sheet stand on which a pile of sheets is stacked;

a feeder for feeding a sheet from a top of said pile of sheets stacked on said sheet stand, one by one, to said sheet processing section;

a return for returning said sheet from said sheet processing section to said sheet stand; and an inserter for inserting said sheet under a bottom of said pile of sheets stacked on said sheet stand, said inserter including;

a conveyance member adapted to contact a leading edge of said sheet returned by said return, and move in an insertion direction for inserting the sheet under said pile of sheets;

a detection member for detecting passage of said sheet returned to said sheet stand and for outputting a detection signal; and a control member for controlling said conveyance member based on said detection signal, to hold the leading edge of the sheet with said holding member, said apparatus further comprising a second detection member for detecting a home position of said conveyance member.

10. The apparatus of claim 9 wherein said control member controls said conveyance member on the basis of a home position detection signal generated by said second detection member, to stop said holding member at a predetermined position.

11. The apparatus of claim 9, wherein said conveyance member is arranged to contact a leading edge of the returned sheet at the home position.

12. An apparatus for repeatedly feeding sheets from a pile of sheets to a sheet processing section, said apparatus comprising:

a sheet stand on which a pile of sheets is stacked;

a feeder for feeding a sheet from a top of said pile of sheets stacked on said sheet stand, one by one, to said sheet processing section;

a return for returning said sheet from said sheet processing section to said sheet stand; and an inserter for inserting said sheet under a bottom of said pile of sheets stacked on said sheet stand, said inserter comprising a conveyance member adapted to contact a leading edge of said sheet returned by said return and move in an insertion direction to insert the sheet under said pile of sheets, said conveyance member comprising an endless belt provided with a holding member for holding a leading edge of said sheet between said holding member and said endless belt, said endless belt being arranged to pass, with said sheet held by said holding member, under the bottom of said pile of sheets, said endless belt and holding member being formed of one piece of belt whereby said belt is looped, and an edge portion extends over a joint in said loop to form said holding member;

a detection member for detecting the edge of said sheet returned to said sheet stand, and for outputting a detection signal; and a control member for controlling said conveyance member based on said detection signal.

* * * * *